US008435163B2

(12) United States Patent
Uygan

(10) Patent No.: US 8,435,163 B2
(45) Date of Patent: May 7, 2013

(54) EXERCISE APPARATUS WITH A PULL CORD LOOPED ABOUT A CENTRAL PULLEY AND FIRST AND SECOND FREE PULLEYS

(75) Inventor: Viktor Uygan, Mission Viejo, CA (US)

(73) Assignee: Balanced Body, Inc., Sacramento, CA (US)

( * ) Notice: Subject to any disclaimer, the term of this patent is extended or adjusted under 35 U.S.C. 154(b) by 434 days.

(21) Appl. No.: 12/916,152

(22) Filed: Oct. 29, 2010

(65) Prior Publication Data

US 2012/0108401 A1 May 3, 2012

Related U.S. Application Data

(62) Division of application No. 11/998,283, filed on Nov. 29, 2007, now Pat. No. 7,850,584.

(51) Int. Cl.
*A63B 21/06* (2006.01)
*A63B 21/062* (2006.01)

(52) U.S. Cl.
USPC ..... 482/102; 482/99

(58) Field of Classification Search ..... 482/10–11, 482/44, 50–51, 56, 79, 92–103, 114–116, 482/118–120, 133–139; *A63B 21/06, 21/062*
See application file for complete search history.

(56) References Cited

U.S. PATENT DOCUMENTS

| | | | | |
|---|---|---|---|---|
| 1,621,477 | A | 3/1927 | Pilates | |
| 1,785,876 | A | 12/1930 | Pilates | |
| 1,874,613 | A | 8/1932 | Pilates | |
| 1,876,743 | A | 9/1932 | Pilates | |
| 1,969,901 | A | 8/1934 | Pilates | |
| 2,132,862 | A | 10/1938 | Pilates | |
| 2,570,855 | A | 10/1951 | Pilates | |
| 4,431,184 | A * | 2/1984 | Lew et al. | 482/43 |
| 4,549,733 | A | 10/1985 | Salyer | |
| 5,681,249 | A | 10/1997 | Endelman | |
| 5,792,033 | A | 8/1998 | Merrithew | |
| 5,928,117 | A * | 7/1999 | Vittone et al. | 482/99 |
| 6,338,704 | B1 | 1/2002 | Endelman | |
| 6,371,895 | B1 | 4/2002 | Endelman et al. | |
| 6,634,997 | B2 | 10/2003 | Breibart et al. | |
| 6,669,609 | B2 | 12/2003 | Gerschefske et al. | |
| 6,837,838 | B2 | 1/2005 | List | |
| 6,916,279 | B2 | 7/2005 | Endelman | |
| 6,926,650 | B2 | 8/2005 | Endelman et al. | |
| 7,104,937 | B2 | 9/2006 | Arbuckle et al. | |
| 7,125,369 | B2 | 10/2006 | Endelman | |
| 7,163,498 | B1 | 1/2007 | Abelbeck | |
| 7,163,500 | B2 | 1/2007 | Endelman et al. | |
| 7,179,207 | B2 | 2/2007 | Gerschefske | |

* cited by examiner

*Primary Examiner* — Oren Ginsberg
(74) *Attorney, Agent, or Firm* — Greenberg Traurig LLP

(57) ABSTRACT

An exercise apparatus includes a frame, first and second free pulleys, first and second handle portions, first and second frame pulleys attached to the frame, a central pulley, a pull cord, and a resistance member. The first free pulley includes a first pulley wheel and a first hub with the first pulley wheel configured to rotate in relation to the first hub. The second free pulley includes a second pulley wheel and a second hub with the second pulley wheel configured to rotate in relation to the second hub. The first and second handle portions are in mechanical communication with the first and second hubs with the pulley wheels configured to rotate relative to the handle portions. The pull cord is looped about the pulleys with the resistance member configured to resist movement of the pull cord.

7 Claims, 6 Drawing Sheets

EXERCISE APPARATUS WITH A PULL CORD LOOPED ABOUT A CENTRAL PULLEY AND FIRST AND SECOND FREE PULLEYS

CROSS-REFERENCE TO RELATED APPLICATIONS

The present application is a divisional patent application of U.S. patent application Ser. No. 11/998,283 filed on Nov. 29, 2007 now U.S. Pat. No. 7,850,584, the entire contents of which are incorporated herein by reference.

STATEMENT RE: FEDERALLY SPONSORED RESEARCH/DEVELOPMENT (Not Applicable)

BACKGROUND

The present invention relates generally to exercise equipment and, more particularly, to an exercise apparatus with a pull cord looped about a central pulley and first and second free pulleys.

The so-called "Pilates" method is a popular form of physical fitness training worldwide. The Pilates method uses a multitude of different exercises designed to increase flexibility, strength, and coordination. A popular exercise apparatus associated with the Pilates method is the "reformer" type apparatus. The reformer type apparatus is basically a resistance exercise apparatus. It consists of a wheeled carriage that is mounted to a rectangular frame. The carriage rides upon frame side rails of the frame translating back and fourth along a frame longitudinal axis. Resistance is provided by the exerciser's body weight and/or by resistance members, such as springs.

The carriage consists of a top side where the exerciser puts his or her body. The carriage includes a top side upon which a pair of shoulder pads and a head pad in between the shoulder pad are disposed. The frame includes a head end and an opposing foot end. The shoulder pads and head pad are disposed adjacent the head end of the frame. The resistance members are attached to the frame and the carriage at the foot end of the frame. A foot rest may be attached to frame at the foot end.

The reformer type apparatus further includes a pair of pull cords. At the head end the frame further includes vertical pulley supports each with a frame pulley. Each of the pull cords are attached to the carriage. The pull cords each respectively extend to and loop about the frame pulleys and terminate at first and second handle portions of the pull cords. When performing exercises the exerciser grasps each of the first and second handle portions.

An exerciser uses the apparatus by laying, sitting or otherwise being supported by the carriage. Many basic reformer exercises are done lying down with the exerciser's head on the head pad with the shoulder pads providing stability to the exerciser. The exerciser's feet may be supported by the foot rest. The carriage is moved along the longitudinal axis by pulling the first or second handle portions and/or by pushing against the foot rest while responding to the effort that the exerciser exerts and the amount of resistance set up by the resistance members. There are also exercises where the exerciser is turned around and places the feet through the first or second handle portions.

There exists a need in the art for an improved reformer type apparatus that facilitates a versatility of the types of exercises that an exerciser may perform using the apparatus in comparison to the prior art.

BRIEF SUMMARY

According to an aspect of the present invention, there is provided an exercise apparatus that includes a frame, first and second free pulleys, first and second handle portions, first and second frame pulleys, a central pulley, a pull cord, and a resistance member. The first free pulley includes a first pulley wheel and a first hub with the first pulley wheel configured to rotate in relation to the first hub. The first handle portion is in mechanical communication with the first hub with the first pulley wheel configured to rotate relative to the first handle portion. The second free pulley includes a second pulley wheel and a second hub with the second pulley wheel configured to rotate in relation to the second hub. The second handle portion is in mechanical communication with the second hub with the second pulley wheel configured to rotate relative to the second handle portion. The first and second frame pulleys are attached to the frame. The pull cord is consecutively looped about the first frame pulley, the first free pulley, the central pulley, the second free pulley and the second frame pulley along the pull cord. The resistance member is in mechanical communication with the pull cord. The resistance member is configured to resist movement of the pull cord with the pull cord being in tension.

According to various embodiments, the exercise apparatus further includes a central pulley locking mechanism that may be configured to engage the central pulley for mitigating movement of the pull cord along the central pulley. The central pulley locking mechanism may be configured to engage the central pulley via engagement with the pull cord. The central pulley locking mechanism may include a cam surface configured to engage the pull cord. The central pulley locking mechanism may be attached to the central pulley. The central pulley may be attached to the frame. The frame defines a frame longitudinal axis, and the exercise apparatus may further include a carriage mounted on the frame and movable along the frame longitudinal axis with the pull cord attached to the carriage. The pull cord may include first and second cord ends that are attached to the carriage. The resistance member may be attached to the carriage and the frame. The resistance member may be configured to resist movement of the carriage along the frame longitudinal axis in a direction towards the first and second frame pulleys. The resistance member may include a plurality of springs. The central pulley may be attached to the carriage. In another embodiment, the resistance member is a resistance weight. The pull cord may include first and second cord ends that are in mechanical communication with the resistance weight. The resistance weight may be configured to resist movement of the first cord end in a direction away from the resistance weight and of the second cord end in a direction away from the resistance weight.

BRIEF DESCRIPTION OF THE DRAWINGS

These and other features and advantages of the various embodiments disclosed herein will be better understood with respect to the following description and drawings in which like numbers refer to like parts throughout and in which.

DETAILED DESCRIPTION

Figure 1:
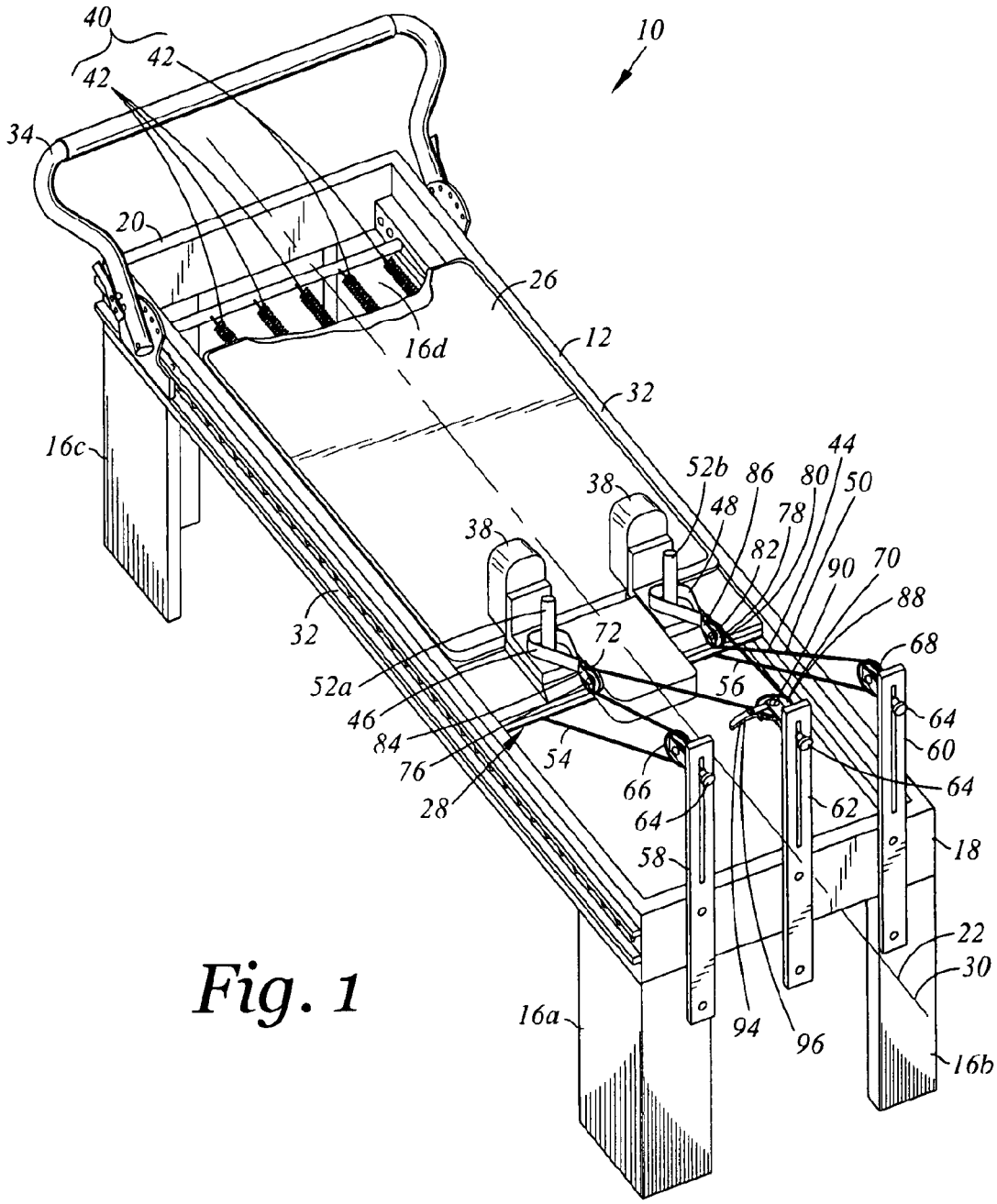
FIG. 1 is a perspective top view of an exercise apparatus including a carriage, a central pulley and first and second free pulleys in accordance with an aspect of the present invention.

Referring now to the drawings wherein the showings are for purposes of illustrating preferred embodiments of the present invention only and not for purposes of limiting the same, FIG. 1 is a perspective top view of an exercise apparatus 10 in accordance with an aspect of the present invention.

The exercise apparatus 10 includes a frame 12 and a carriage 24. In the embodiment depicted, the frame 12 is generally rectangular and includes a frame body 14 which is supported by frame legs 16*a-d*. The frame 12 includes a frame head end 18 and frame foot end 20, and defines a frame longitudinal axis 22.

According to an aspect of the present invention, the exercise apparatus 10 includes the frame 12, first and second free pulleys 72, 78, first and second handle portions 46, 48, first and second frame pulleys 66, 68, a central pulley 70, a pull cord 44, and a resistance member 40. The first free pulley 72 includes a first pulley wheel 74 and a first hub 76 with the first pulley wheel 74 configured to rotate in relation to the first hub 76. The first handle portion 46 is in mechanical communication with the first hub 76 with the first pulley wheel 74 configured to rotate relative to the first handle portion 46. The second free pulley 78 includes a second pulley wheel 80 and a second hub 82 with the second pulley wheel 80 configured to rotate in relation to the second hub 82. The second handle portion 48 is in mechanical communication with the second hub 82 with the second pulley wheel 80 configured to rotate relative to the second handle portion 48. The first and second frame pulleys 66, 68 are attached to the frame 12. The pull cord 44 is consecutively looped about the first frame pulley 66, the first free pulley 72, the central pulley 70, the second free pulley 78 and the second frame pulley 68 along the pull cord 44. The resistance member 40 is in mechanical communication with the pull cord 44. The resistance member 40 is configured to resist movement of the pull cord 44 with the pull cord 44 being in tension.

In further detail according to various embodiments, the carriage 24 includes a carriage top side 26 and an opposing carriage bottom side 28. The carriage top side 26 may be padded as depicted. The carriage top side 26 is disposed generally facing away from the frame 12, and the carriage bottom side 28 is disposed generally facing towards the frame 12. The carriage 24 defines a carriage longitudinal axis 30 parallel to the frame longitudinal axis 22. The frame 24 may include frame side rails 32. As mentioned above, the carriage 24 is mounted to the frame 12 and movable along the frame longitudinal axis 22. The carriage 24 may be cooperatively formed to slidably engage the frame side rails 32. Though not depicted, the carriage 24 may be provided with wheels, bearings or sliders at the carriage bottom side 28 to facilitate such movability. It is contemplated that various methods for facilitating the mounting of the carriage 24 to the frame 12 may be chosen from any of those which are well known to one of ordinary skill in the art. While the carriage 24 is depicted in a horizontal configuration, it is contemplated that other angulations may be utilized as well.

The frame 24 may include a foot rest 34 at the frame foot end 20. The carriage may include a head pad 36 and a pair of shoulder pads 38 disposed about the head pad 26 upon the carriage top side 26 adjacent the frame head end 18. An exerciser using the exercise apparatus 10 may be positioned laying one his/her back upon the carriage 24 with feet supported by the foot rest 34 and head and shoulders respectively supported by the head pad 26 and shoulder pads 38.

As mentioned above the exercise apparatus 10 may include the resistance member 40. In the particular embodiment depicted, the resistance member 40 takes the form of springs 42. The resistance member 40 may be attached to the carriage 24 at the carriage bottom side 28 and the frame 12 at the frame foot end 20. The resistance member 40 is configured to resist translation Of the carriage 24 in a direction away from the frame foot end 20 towards the frame head end 18. It is contemplated that the resistance member 40 may take other forms such as elastic bands and weights using gravity to provide desired resistance levels.

In the embodiment shown, the frame 12 includes first and second frame pulley supports 58, 60 and a central pulley support 62. The first and second frame pulleys 66, 68 are respectively attached to the first and second frame pulley supports 58, 60. The central pulley 70 is attached to the central pulley support 62. The first and second frame pulley supports 58, 60 and the central pulley support 62 are generally disposed in a vertical configuration. The first and second frame pulleys 58, 60 and the central pulley 70 may be adjustably attached to the first and second pulley supports 58, 60 and the central pulley support 62 along a length of each of the first and second pulley supports 58, 60 and the central pulley support 62. An adjustment knob 64 may be provided to each of the first and second frame pulley supports 58, 60 and central pulley support 62 to facilitate such adjustable attachment. This provides a variety of angulations with respect to the pull cord 44 in relation to the exerciser and may facilitate a variety of exercises.

The pull cord 44 includes first and second pull cord ends 54, 56 and a pull cord body 50 that extends between the first and second pull cord ends 54, 56. The first and second pull cord ends 54, 56 are attached to the carriage 24 at the carriage bottom side 28 adjacent the frame head end 18. The pull cord 44 may be formed of any variety of materials and configuration which may be chosen from those which are well known to one of ordinary skill in the art. For example, the pull cord 44 may be formed of fibers which are woven, unwoven, or twisted, and may be of natural or synthetic materials (such as nylon, other plastics, rubber materials, wire, and blends). The pull cord 44 may be a continuous piece of material having material continuity or formed of several segments that are attached or knotted together.

Figure 2:
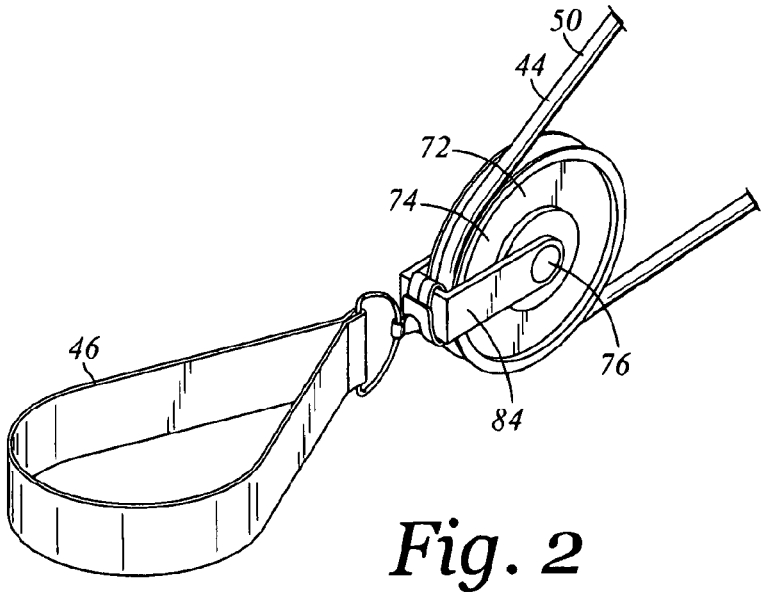
FIG. 2 is an enlarged perspective view of the first free pulley and a portion of a pull cord.

In the embodiment depicted, the first and second handle portions 46, 48 take the form of straps. However, the first and second handle portions 46, 48 may take other forms, such as being formed of a rope like material or a rigid metal or plastic material for examples. Further in this embodiment, the first and second handle portions 46, 48 are respectively provided with first and second handle supports 84, 86. The first handle support 84 is disposed between the first handle portion 46 and the first free pulley 72. In particular, the first handle support 84 is attached to the first hub 76. FIG. 2 depicts an enlarged perspective view of the first free pulley 74, the first handle portion 46, the first handle support 84 and a portion of the pull cord 44. In addition, the second handle support 86 is disposed between the second handle portion 48 and the second free pulley 78. In particular, the second handle support 86 is attached to the second hub 82. In this regard, the first and second handle supports 84, 86 facilitate the first and second handle portions 46, 48 to be disposed in mechanical communication with the first and second free pulleys 72, 78 while allowing the first and second pulley wheels 74, 80 to respectively rotate in relation to each of the first and second hubs 76, 82.

It is contemplated that various components of the exercise apparatus 10 may be integrally formed with other components so as to be formed from a single piece of material. For example, the first handle portion 46, the first handle support 84 and the first hub 76 (and combinations thereof) may be integrally formed elements.

The carriage 24 may include posts 52*a, b*. The first and second handle portions 46, 48 may be engaged with the posts 52*a, b* as a convenient location to dispose of the first and second handle portions 46, 48 when not in use by the exerciser.

Figure 3:
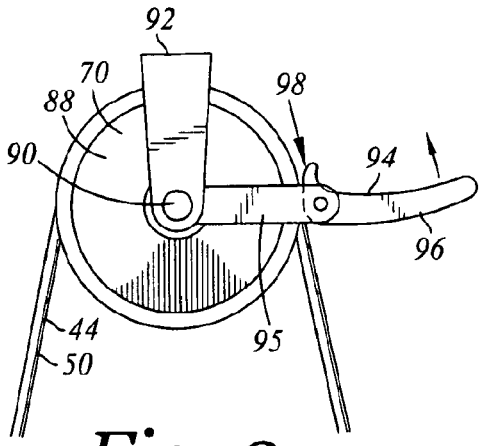
FIG. 3 is an enlarged front view of the central pulley and a portion the pull cord with a central locking mechanism depicted in an unlocked position.
Figure 4:
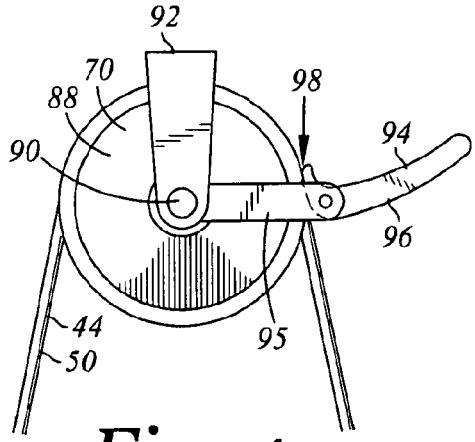
FIG. 4 is the view of FIG. 3 with the central locking mechanism depicted in a locked position.

The exercise apparatus 10 may include a central locking mechanism 94. Referring additionally now to FIG. 3, there is depicted an enlarged front view of the central pulley 60 and a portion of the pull cord 44 with a central locking mechanism 94 depicted in an unlocked position. FIG. 4 is the view of FIG. 3 with the central locking mechanism 94 depicted in a locked position.

In the embodiment depicted, the central pulley 70 includes a central pulley wheel 88 and a central hub 90. The central pulley wheel 88 is configured to rotate in relation to the central hub 90. A central hub support 92 may be provided to attach the central pulley 70 to frame 12 via the central pulley support 62. In this regard, the central hub support 92 may be attached to the central hub 90 and the central hub support 62 with the use of the adjustment knob 64.

The central locking mechanism 94 includes a lever 96 and a locking mechanism support 95. The locking mechanism support 95 is configured to attach the lever 96 adjacent the central pulley 70. The locking mechanism support 95 is attached to the central hub 90 and the lever 96. The lever 96 is pivotally attached to the locking mechanism support 95. The lever 96 includes a cam surface 98 disposed towards the outer periphery of the central pulley wheel 88 and the portion of the pull cord body 50 that is looped about the central pulley 70. In the unlocked position, the cam surface 98 is not in contact with the central pulley wheel 88 or the pull cord body 50. In the locked position, the cam surface 98 is disposed in contact with the central pulley wheel 88 and the pull cord body 50. The pull cord body 50 is pinched between the cam surface 98 and the central pulley wheel 88. This tends to mitigate movement of the pull cord body 50 along the central pulley wheel 88. In addition, the contact between the cam surface 98 and the central pulley wheel 88, directly and via the pinching action of the pull cord body 50, tends to mitigate movement or rotation of the central pulley wheel 88. The central pulley locking mechanism 92 may be of other configurations. For example, in another embodiment, a lock pin may be used to engage the central pulley wheel 88 to prevent or otherwise mitigation rotation of the central pulley wheel 88 and thereby resist movement of the pull cord body 50 along the central pulley 70.

As used herein the term "pulley" refers to a component used with the exercise apparatus 10 that interfaces with the pull cord 44 to provide a mechanical advantage with the pull cord 44 imparting force upon the pulley. The pulley may be rotational in nature with a wheel rotating about an axis of rotation. The wheel may include a hub or pin (or fasteners such as bolts). In addition, bearings may be utilized to facilitate rotation. The pulley may be non-rotational in nature with the pull cord 44 in slidable contact with the pulley. Moreover, the components comprising the pulley may be incorporated or integrated with other components of the exercise apparatus 10.

In the embodiment depicted in FIG. 1, the first and second hubs 76, 82 are disposed through a central axis of rotation of each of the first and second pulley wheels 74, 80. The first and second pulley wheels 74, 80 are each configured to rotate about the first and second hubs 76, 82. However, it is contemplated that the first and second pulley wheels 74, 80 may be engaged with the first and second hubs 76, 82 in such a manner as the first and second hubs 76, 82 are not disposed through a central axis of rotation of each of the first and second pulley wheels 74, 80. For example, the first and second hubs 76, 82 may be disposed radially away from central axis of rotation so as to engage a rim of the first and second pulley wheels 74, 80.

As used herein the terms "along the pull cord 44" refers to a pulley being looped by the pull cord 44 relative in longitudinal position to other pulleys being looped by the pull cord 44. Moreover, as used herein the terms the "pull cord consecutively looped about" refers to the pull cord 44 being looped such that the associated pulleys are sequentially looped with the pull cord 44 relative in longitudinal position to other pulleys being looped by the pull cord 44. It is understood that such consecutive looping does not preclude other pulleys or elements from being looped by the pull cord 44 in between the subject pulleys. As mentioned above, the pull cord 44 is consecutively looped about the first frame pulley 66, the first free pulley 72, the central pulley 70, the second free pulley 78 and the second frame pulley 68 along the pull cord 44. Thus, it is understood that in other embodiments additional pulleys may be provided that are looped with the pull cord 44 between the first frame pulley 66 and the first free pulley 72, and yet the pull cord 44 would be still considered consecutively looped about the first frame pulley 66 and the first free pulley 72.

Figure 5:
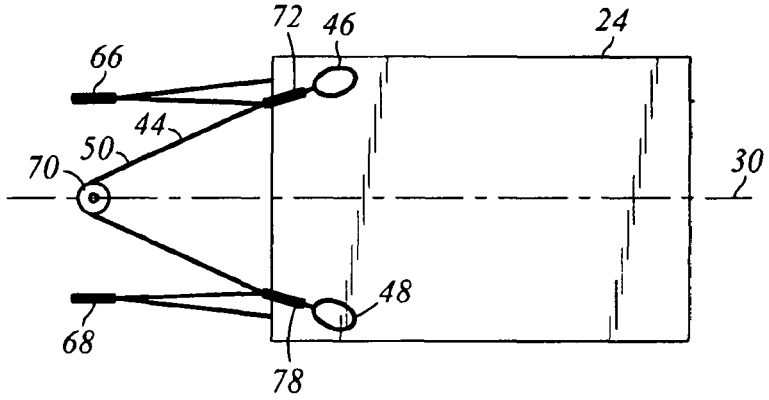
FIG. 5 is a top symbolic view of the carriage, pulleys and the pull cord having first and second handle portions attached to the first and second free pulleys.

Referring now to FIGS. 5-9 there are depicted top symbolic views to facilitate a discussion of some of the relative movements of the exercise apparatus 10. FIG. 5 is a top symbolic view of the carriage 24 and the pull cord 44 having the first and second handle portions 46, 48 in a sample starting position. For example, an exerciser may be grasping the first and second handle portions 46, 48 while lying upon the carriage 24 with the exerciser's back against the carriage top side 26.

Figure 6:
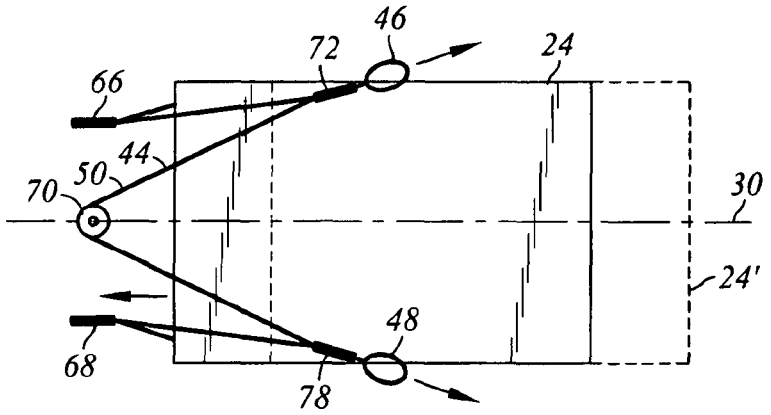
FIG. 6 is the view of FIG. 5, however, with the carriage translated to the left and the first and second handle portions extended to the right.

Referring now to FIG. 6, there is depicted the view of FIG. 5, however, with the carriage 24 translated to the left and the first and second handle portions 46, 48 extended to the right (for reference the carriage starting position as depicted in FIG. 5 is denoted in dashed line carriage 24'). This is an example of the exerciser having equally pulled the first and second handle portions 46, 48. The movement of the carriage 24 is resisted by the resistance member 40.

The exercise apparatus 10 may be used with the central locking mechanism 94 in either a locked or an unlocked position. In the locked position, the exemplary transition between the states of the exercise apparatus 10 of FIG. 5 to FIG. 6 illustrates how the exercise apparatus 10 facilitates a movement or exercise that may be performed on a traditional reformer type exercise apparatus. In this regard, the exerciser may pull with an unequal exertion on the first and second handle portions 46, 48 and the carriage 24 is still moved as a result. For example, a user may pull with only the exerciser's left arm and the carriage 24 would still move. While the pull cord body 50 would be disposed in tension along those segments between the central pulley 66 and the first handle portion 46, those segments of the pull cord body 50 between the central pulley 66 and the second handle portion 48 would become slack (or have less tension).

Advantageously, the exerciser may initially place the central locking mechanism 94 in an unlocked position so as to adjust or equalize the segments length between the first and second frame pulleys 58, 60 in relation to the first and second handle portions 46, 48. In this regard, while the exercise apparatus 10 may be subsequently used with the central locking mechanism 92 in a locked position, this allows for an efficient relative length adjustment of the first and second handle portions 46, 48 in comparison to a traditional reformer type exercise apparatus. This is because a traditional reformer type exercise apparatus has two independent pull cords with each pull cord having to be adjusted in length relative to each other. This may entail an awkward and time consuming fastening/unfastening process. The central locking mechanism 94 allows for an adjustment with a simple movement, such as by rotating the lever 96 (though it is understood that a lever is not required as other configurations of the central locking mechanism 94 are contemplated).

However, as mentioned above, the central locking mechanism 94 advantageously allows the exercise apparatus 10 to be used to perform exercises with the central locking mechanism 92 in an unlocked position. In the unlocked position, the exemplary transition between the states of the exercise apparatus 10 of FIG. 5 to FIG. 6 also illustrates how the exercise apparatus 10 facilitates a movement or exercise that is not feasible of being performed on a traditional reformer type exercise apparatus. The amount of exertion between limbs may be considered relatively independent.

With the central locking mechanism 94 in the unlocked position, the equal movement of the first and second handle portions 46, 48 against the resistance of the resistance member 40 when affecting a movement of the carriage 24 requires proprioceptive or coordinated movements of the exerciser. Allowing the exerciser to perform proprioceptive movements adds significant versatility to the types of exercises that may be conducted with the exercise apparatus 10. Thus, the exerciser must equally exert force upon each of the first and second handle portions 46, 48 in order to move the carriage 24 and have the both of the first and second handle portions move in unison. This arrangement provides an immediate feedback to the exerciser because an unequal exertion would result in an unequal positioning of the first and second handle portions 46, 48. The exerciser may use the exercise apparatus 10 to perform exercises with the exertion of the exerciser's limbs being dependent upon each other.

Figure 7:
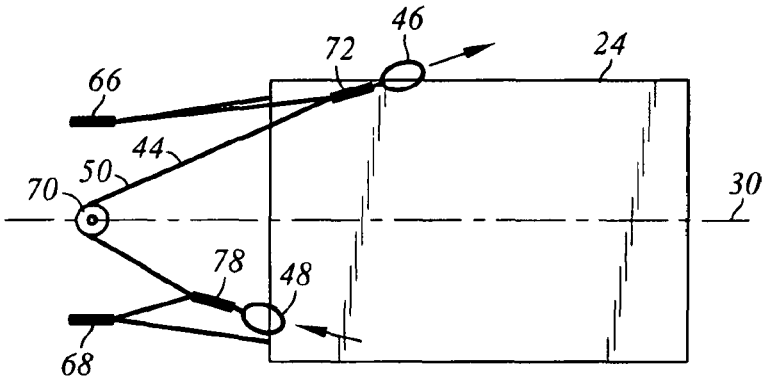
FIG. 7 is the view of FIG. 5, however, with the first handle portion extended to the right and the second handle portion translated to the left.

Referring to FIG. 7, there is depicted the first handle portion 46 extended to the right and the second handle portion 48 translated to the left. This may be a result of the exerciser exerting a significant imbalance of force between the exerciser's limbs. The carriage 24 is in the same position as that of FIG. 5. Thus, the exerciser may use the exercise apparatus 10 to perform repetitive opposite movements alternating between limbs.

Figure 8:
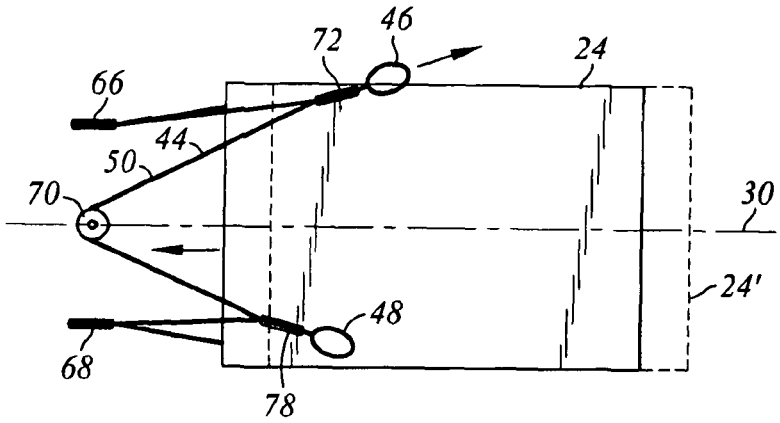
FIG. 8 is the view of FIG. 5, however, with the carriage translated to the left and the first handle portion extended to the right.

Referring to FIG. 8, there is depicted the first handle portion 46 extended to the right and the second handle portion 48 translated to the left. The carriage 24 is in the same position as that of FIG. 5. This illustrates an exercise that allows the exerciser to focus or isolate upon a single limb Referring to FIG. 9, there is depicted the view of FIG. 5, however, with the carriage 24 translated to the left, the first handle portion 46 extended to the right and the second handle portion 48 also translated to the right with an unequal amount of extension. The central locking mechanism 92 is in the unlocked position. This illustrates an exercise that allows the exerciser to focus or isolate upon a single limb while also activating or exerting muscles of the other limb and core of the exerciser. In this exercise, exertion is used by both limbs to move the carnage 24 to the left. Next, the exerciser attempts to generally maintain the relative position of the second handle portion 48. At the same instance, the exerciser pulls the first handle portion 46 to extend the pull cord body 50 away from the first frame pulley 58 in a repetitive movement (such as curls or arm lifts).

Figure 9:
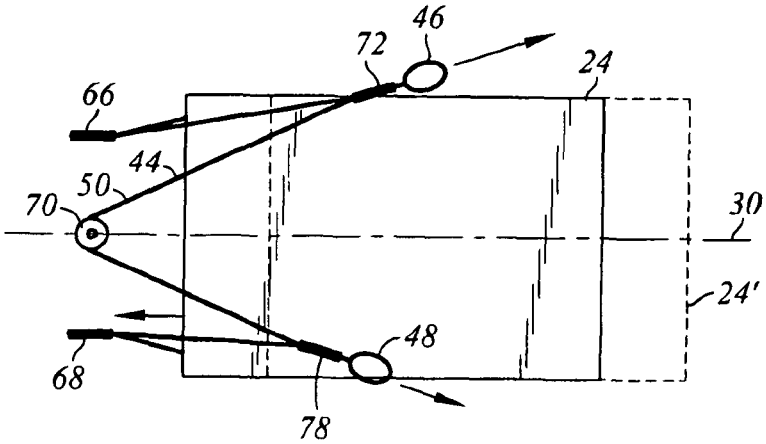
FIG. 9 is the view of FIG. 10, however, with the carriage further translated to the left, the first handle portion further extended to the right and the second handle portion extended to the right.

Referring to FIG. 9, there is depicted the view of FIG. 6, however, with the carriage 24 translated to the left, the first handle portion 46 extended to the right and the second handle portion 48 also translated to the right with an unequal amount of extension. The central locking mechanism 92 is in the unlocked position. This illustrates an example where the exerciser may be attempting unsuccessfully to equally pull upon the first and second handle portions 46, 48. As such, the exerciser is provided feedback of such unequal exertion because it is readily apparent that the positioning of the first and second handle portions 46, 48 are not the same.

It is understood that FIG. 5-9 only illustrate a selected few example of the variety of exercises that may be performed using the exercise apparatus 10. For example, the exerciser need not be lying upon the exerciser's back. Moreover, the exerciser need not grasp the first and second handle portions 46, 48 with both hands. Rather, a combination of hands and/or feet may be used as well.

In addition, according to another aspect of the present invention, there is provided a retrofit kit that may be used with an existing exercise apparatus, such as a traditional reformer type exercise apparatus. In this regard, the retrofit kit that includes at least the first and second free pulleys 72, 78, the first and second handle portions 46, 48, the central pulley 66, the central pulley locking mechanism 94 and the pull cord 44.

Figure 10:
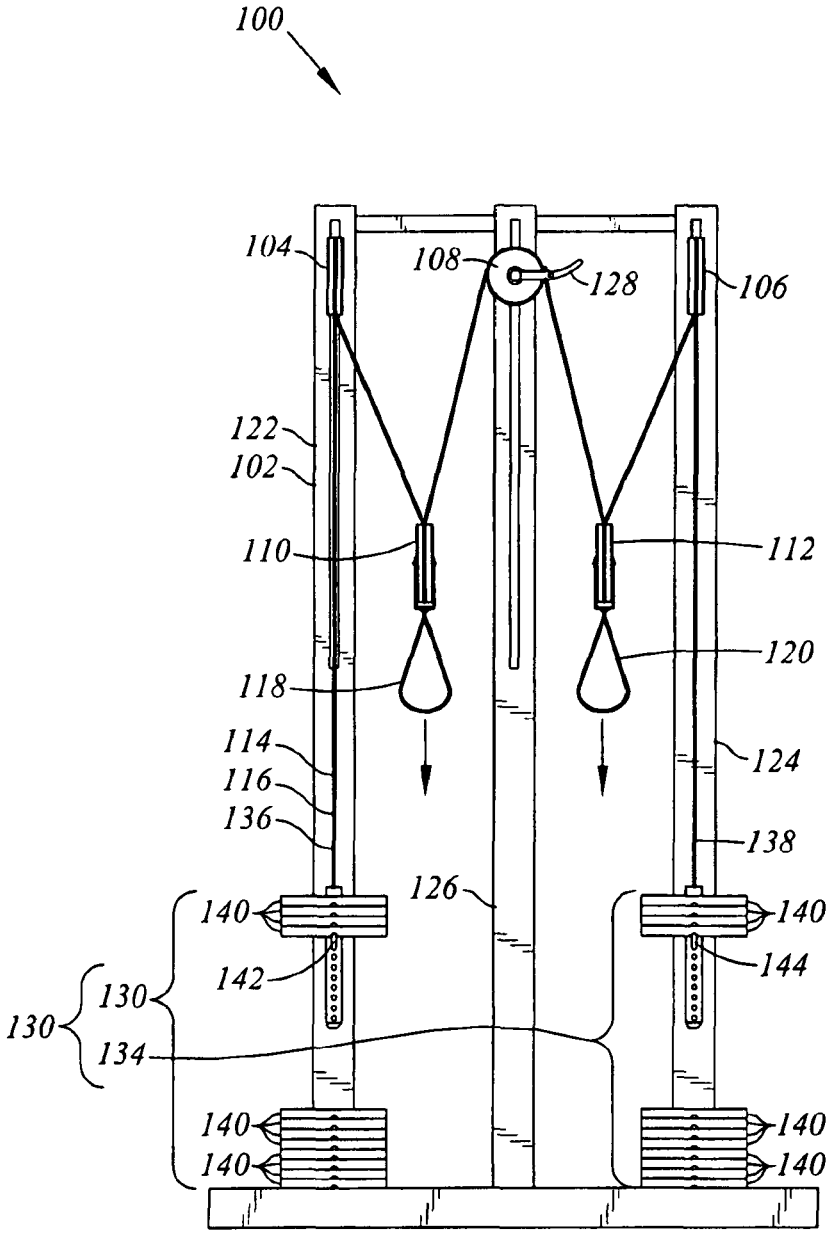
FIG. 10 is a front view of an exercise apparatus a pull cord attached to resistance weights in accordance with another aspect of the present invention.

Referring now to FIG. 10, there is depicted an exercise apparatus 100 according to another aspect of the present invention. The exercise apparatus 100 of this embodiment is of an "up-right" nature and does require use of any moving carriage. The exercise apparatus 100 includes a frame 102, first and second frame pulleys 104, 106, a central pulley 108, first and second free pulleys 110, 112, a pull cord 114, first and second handle portions 116, 118, a pull cord 44, and a resistance member 130. The first and second frame pulleys 104, 106, the central pulley 108, the first and second free pulleys 110, 112, and the first and second handle portions 116, 118 may be similarly constructed as the first and second frame pulleys 66, 68, the central pulley 70, the first and second free pulleys 72, 78, and the first and second handle portions 46, 48 as described above. The first and second frame pulleys 104, 106 are attached to the frame 102. The pull cord 114 is consecutively looped about the first frame pulley 104, the first free pulley 110, the central pulley 108, the second free pulley 112 and the second frame pulley 106 along the pull cord 114. The resistance member 40 is in mechanical communication with the pull cord 114. The resistance member 130 is configured to resist movement of the pull cord 114 with the pull cord 114 being in tension.

The frame 102 may include first and second frame pulley supports 122, 124 and a central pulley support 126. The first and second frame pulleys 104, 106 and the central pulley 108 are respectively attached to the frame 102 via attachment to the first and second frame pulley supports 122, 124 and the central pulley support 126.

A central pulley locking mechanism 128 may be provided and configured similar to the central pulley locking mechanism 94 as described above. The central pulley locking mechanism 128 may be used to engage the central pulley 70 to mitigate movement of the pull cord 104 along the central pulley 70.

In this embodiment, the resistance member 130 takes the form of first and second weight stacks 132, 134. Each of the first and second weight stacks 132, 134 includes a plurality of resistance weights 140. The pull cord 104 includes first and second cord ends 136, 138. The first cord end 136 is configured to be engaged with the first weight stack 132, and the second cord end 138 is configured to be engaged with the second weight stack 134. The first and second locking pins 142, 144 are provided that may be engaged with the first and second cord ends 136, 138. The first and second locking pins 142, 144 facilitate engagement with selected ones of the resistance weights 140 that define portions of the first and second weight stacks 132, 134. This allows for an ease of adjusting desired resistance to be applied to the pull cord 104. While this embodiment a resistance member 130 in the form of weights, other configurations may be utilized such as springs or elastic bands for example. Though not depicted, it is contemplated that additional handles may be provided with the pull cord 104. For example the first and second cord ends 136, 138 may be looped about a pair of additional pulleys that are engageable with the weight stacks 132, 134. Additional handles may be affixed to the first and second cord ends 136, 138.

Figure 11:
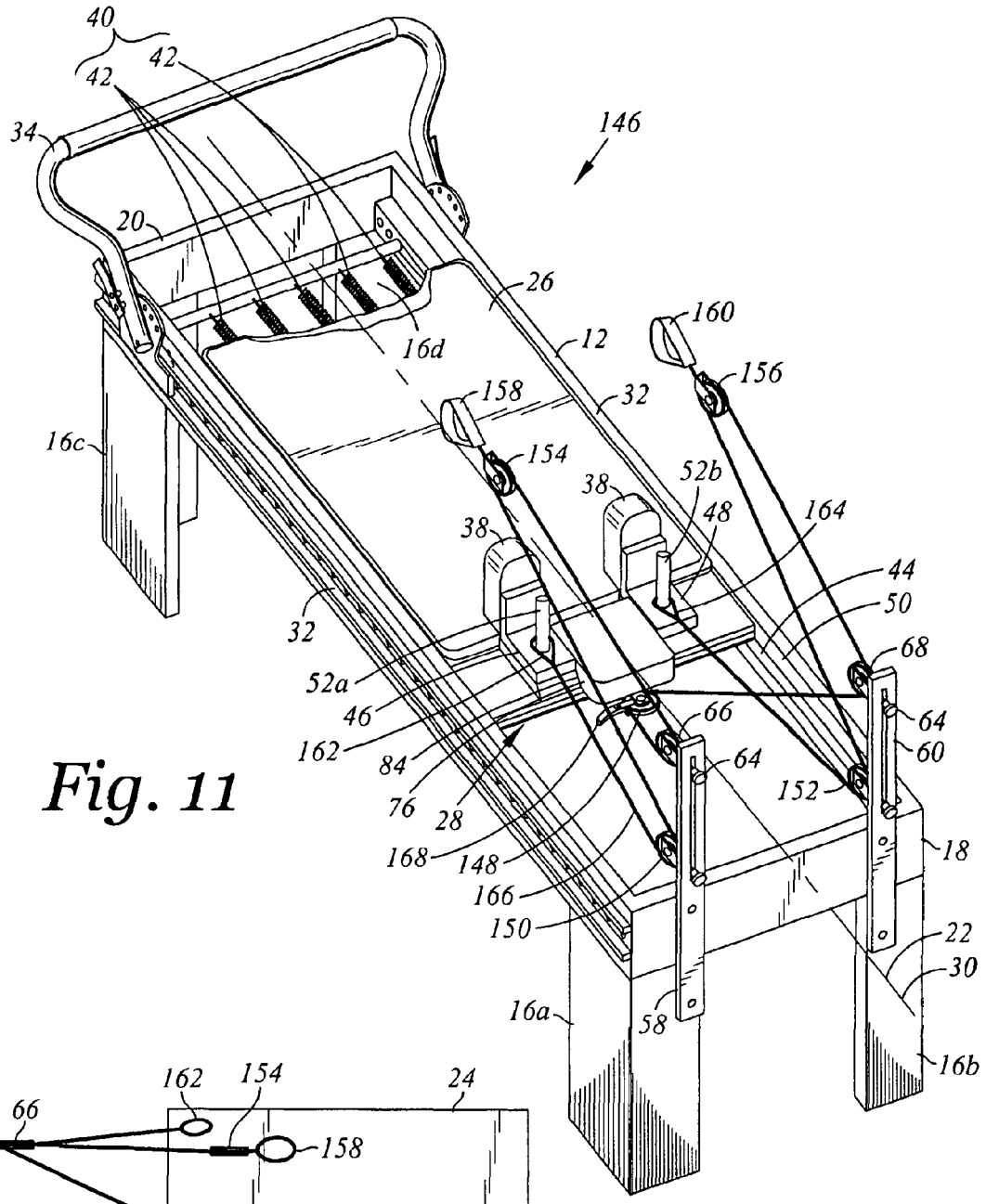
FIG. 11 is a perspective top view of an exercise apparatus including a central pulley attached to a carriage in accordance with another aspect of the present invention.
Figure 12:
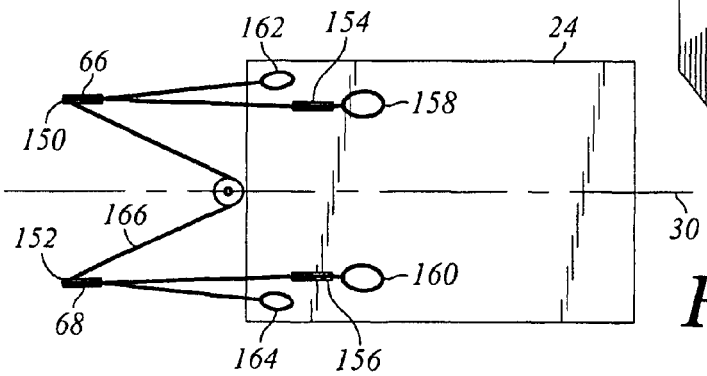
FIG. 12 is a top symbolic view of the carriage, pulleys and a pull cord of the exercise apparatus of FIG. 11.

Referring now to FIG. 11, there is depicted an exercise apparatus 146 according to another aspect of the present invention. The exercise apparatus 146 of this embodiment is of a general configuration similar to that as depicted in FIG. 1. In this regard common reference numerals indicate similar structures with differences in this embodiment as noted below. FIG. 12 is a top symbolic view of portions of the exercise apparatus 146 of FIG. 11. This embodiment features a central pulley 148 that is attached to the carriage 24. FIG. 11 is a perspective top view of an exercise apparatus 146.

The exercise apparatus 146 includes the frame 12 with the first and second frame pulleys 66, 68. The first and second frame pulleys 66, 68 may be respectively attached to the first and second frame pulley supports 58, 60 such as depicted. In addition, third and fourth frame pulleys 150, 152 are provided and may also be respectively attached to the first and second frame pulley supports 58, 60. The exercise apparatus 146 further includes first and second free pulleys 154, 156 respectively with first and second handle portions 158, 160, third and fourth handle portions 162, 166, the central pulley 148, a pull cord 166, and the resistance member 40. The first and second free pulleys 152, 154 and the first and second handle portions 158, 160 may be similar in configuration to the first and second free pulleys 72, 78 and the first and second handle portions 46, 48 as described above. Beginning from the third handle portion 162, the pull cord 166 is consecutively looped about the third frame pulley 150, the first free pulley 154, the first frame pulley 66, the central pulley 148, the second frame pulley 68, the second free pulley 156, the fourth frame pulley 152 along the pull cord 166. The resistance member 40 is in mechanical communication with the pull cord 166. The resistance member 40 is configured to resist movement of the pull cord 166 with the pull cord 44 being in tension.

The central pulley 148 may be provided with a central pulley locking mechanism 168. The central pulley locking mechanism 168 may be configured similar to the central pulley locking mechanism 94 as described above, so as to mitigate relative movement of the pull cord 166. The pull cord 166 may be unlocked in relation to the central pulley 148. This results in a system whereby pulling of any one of the first, second, third or fourth handle portions 158, 160, 162, 164 impacts the forces experienced by the remaining ones of the first, second, third or fourth handle portions 158, 160, 162, 164. This is because a the pull cord 166 is commonly connected to all of the first, second, third or fourth handle portions 158, 160, 162, 164 and are in this respect dependent. However, the pull cord 166 may be locked in relation to the central pulley 148, such as through the use of the central pulley locking mechanism 168. This results in only the first and third handle portions 158, 162 being dependent on each other, and the second and fourth handle portions 160, 164 being dependent on each other.

In the configuration depicted in FIG. 11, the third and fourth handle portions 162, 164 are respectively looped about the posts 52*a, b*. This allows an exerciser to grasp the first and second handle portions 158, 160. In this configuration, the exercise apparatus 146 may be used in a manner as described above in the context of the exercise apparatus 10. However, because this exercise apparatus 146 features two additional handles, it is contemplated that all for limbs of an exerciser may be engaged simultaneously. This allows for a fullbody exercise that requires proprioceptive or coordinated movements of all of the exerciser's limbs. In addition, an exerciser's limbs on just one side of their body may be engaged as well. For example, an exerciser may work out just their left arm and left leg by respectively engaging the first and third handle portions 158, 162 during a given exercise.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An exercise apparatus comprising:

a frame;

a first free pulley including a first pulley wheel and a first hub with the first pulley wheel configured to rotate in relation to the first hub, the first free pulley not being attached to the frame;

a first handle portion in mechanical communication with the first hub with the first pulley wheel configured to rotate relative to the first handle portion;

a second free pulley including a second pulley wheel and a second hub with the second pulley wheel configured to rotate in relation to the second hub, the second free pulley not being attached to the frame;

a second handle portion in mechanical communication with the second hub with the second pulley wheel configured to rotate relative to the second handle portion;

a first frame pulley attached to the frame;

a second frame pulley attached to the frame;

a central pulley;

a pull cord consecutively looped about the first frame pulley, the first free pulley, the central pulley, the second free pulley and the second frame pulley along the pull cord; and a resistance member in mechanical communication with the pull cord, the resistance member configured to resist movement of the pull cord with the pull cord being in tension, the resistance member being a resistance weight;

wherein the pull cord including first and second cord ends that are in mechanical communication with the resistance weight, the resistance weight being configured to resist movement of the first cord end in a direction away from the resistance weight and of the second cord end in a direction away from the resistance weight; and wherein the first free pulley only being in mechanical communication with the exercise apparatus via the pull cord, the second free pulley only being in mechanical communication with the exercise apparatus via the pull cord.

2. The exercise apparatus of claim 1 further includes:

a third handle portion attached to the pull cord, the first frame pulley being disposed between the third handle portion and the first free pulley along the pull cord; and a fourth handle portion attached to the pull cord, the second frame pulley being disposed between the fourth handle portion and the second free pulley along the pull cord.

3. The exercise apparatus of claim 1 further includes a central pulley locking mechanism configured to engage the central pulley for mitigating movement of the pull cord along the central pulley.

4. The exercise apparatus of claim 3 wherein the central pulley locking mechanism is configured to engage the central pulley via engagement with the pull cord.

5. The exercise apparatus of claim 3 wherein the central pulley locking mechanism is attached to the central pulley.

6. The exercise apparatus of claim 4 wherein the central pulley locking mechanism includes a cam surface configured to engage the pull cord.

7. The exercise apparatus of claim 1 wherein the central pulley is attached to the frame.

* * * * *